US009031442B2

(12) United States Patent
Koyama et al.

(10) Patent No.: US 9,031,442 B2
(45) Date of Patent: May 12, 2015

(54) IMAGE-FORMING APPARATUS THAT CORRECTS DETECTED TEMPERATURE OF HEATING MEMBER DETECTED BY NON-CONTACT TEMPERATURE SENSOR

(71) Applicants: Tatsuya Koyama, Toyoake (JP); Yuki Fukusada, Gifu (JP)

(72) Inventors: Tatsuya Koyama, Toyoake (JP); Yuki Fukusada, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/091,357

(22) Filed: Nov. 27, 2013

(65) Prior Publication Data

US 2014/0153948 A1 Jun. 5, 2014

(30) Foreign Application Priority Data

Nov. 30, 2012 (JP) ..... 2012-261987

(51) Int. Cl.
*G03G 15/20* (2006.01)

(52) U.S. Cl.
CPC ..... *G03G 15/205* (2013.01)

(58) Field of Classification Search
USPC ..... 399/67, 69, 328, 329, 70, 330
See application file for complete search history.

(56) References Cited

U.S. PATENT DOCUMENTS 7,729,628 B2 * 6/2010 Nakayama ..... 399/69
2010/0129106 A1 * 5/2010 Tajiri et al. ..... 399/70

FOREIGN PATENT DOCUMENTS

JP 2009-139415 A 6/2009

* cited by examiner

*Primary Examiner* — Roy Y Yi
(74) *Attorney, Agent, or Firm* — Banner & Witcoff, Ltd.

(57) ABSTRACT

An image-forming apparatus includes: a fixing device; a power supply unit; a non-contact temperature sensor; and a control device. The fixing device has a heating member. The power supply unit is configured to supply electric power to the heating member. The non-contact temperature sensor is disposed in a position separate from the heating member and configured to detect temperature of the heating member. A first function and a second function respectively produce a first corrected temperature value and a second corrected temperature value smaller than the first corrected temperature value with respect to a given detected temperature. The control device is configured to: select the first function to correct the detected temperature at a start of a print control process; switch from the first function to the second function at a prescribed timing during the print control process; and control the power supply unit based on the corrected temperature.

11 Claims, 3 Drawing Sheets

FIG.2A FIRST MAP

| | FIRST INTERVAL (8s) | SECOND INTERVAL (10s) | THIRD INTERVAL (25s) | FOURTH INTERVAL |
|---|---|---|---|---|
| Ts≦50℃ | T=1.2x + 25 | T=1.2x + 10 | T=1.2x + 5 | T=1.2x − 5 |

FIG.2B SECOND MAP

| | FIRST INTERVAL (8s) | SECOND INTERVAL (10s) | THIRD INTERVAL (25s) | FOURTH INTERVAL |
|---|---|---|---|---|
| 50℃<Ts≦100℃ | T=1.2x + 15 | T=1.2x + 5 | T=1.2x + 3 | T=1.2x − 5 |

FIG.2C THIRD MAP

| | FIRST INTERVAL (4s) | SECOND INTERVAL |
|---|---|---|
| 100℃<Ts | T=1.2x | T=1.2x − 5 |

IMAGE-FORMING APPARATUS THAT CORRECTS DETECTED TEMPERATURE OF HEATING MEMBER DETECTED BY NON-CONTACT TEMPERATURE SENSOR

CROSS REFERENCE TO RELATED APPLICATION

This application claims priority from Japanese Patent Application No. 2012-261987 filed Nov. 30, 2012. The entire content of the priority application is incorporated herein by reference.

TECHNICAL FIELD

The present invention relates to an image-forming apparatus having a non-contact temperature sensor for detecting the temperature of a heating member.

BACKGROUND

An image-forming apparatus known in the art comprises a heating member for heating a recording sheet, a non-contact temperature sensor separated from the heating member for detecting the ambient temperature around the heating member, and a control device for controlling the temperature of the heating member based on the temperature detected by the temperature sensor. More specifically, this conventional image-forming apparatus employs a technique to adjust the temperature detected by the temperature sensor using a prescribed function for approximating the actual temperature of the heating member and regulates the temperature of the heating member based on this adjusted temperature. In this technique, the conventional image-forming apparatus also changes the function for estimating temperature based on the detected temperature. Conventionally, one function has been selected for the range of temperatures detected during the entire print control process, from start to finish, such as the temperature range 175-200° C.

However, the conventional image-forming apparatus described above employs a non-contact temperature sensor for measuring ambient temperature around the heating member, but the ambient temperature does not closely follow the rapid rise in the temperature of the heating member that occurs during the warm-up period. Consequently, the difference between the actual temperature of the heating member and the ambient temperature (detected temperature) can be much greater at the start of print control, following completion of the warm-up operation, than during the latter half of print control. In such cases, the conventional image-forming apparatus using a single function for correcting the detected temperature during the print control process cannot control fixing operations with accuracy. That is, the conventional image-forming apparatus cannot approximate the actual temperature using a temperature corrected with the same function when the difference between the actual temperature and the detected temperature of the heating member is great at the start of print control that directly follows a warm-up operation. As a consequence, the control device may increase the amount of power supplied to the heating member, causing the temperature of the heating member to rise too high.

SUMMARY

In view of the foregoing, it is an object of the present invention to provide an image-forming apparatus capable of controlling fixing operations with precision.

In order to attain the above and other objects, the present invention provides an image-forming apparatus including: a fixing device; a power supply unit; a non-contact temperature sensor; and a control device. The fixing device has a heating member. The heating member is configured to heat a recording sheet. The non-contact temperature sensor is disposed in a position separate from the heating member and configured to detect temperature of the heating member. The control device is configured to: start a print control process after completion of a warm-up process of the heating member; select one of a plurality of functions to correct the detected temperature detected by the non-contact temperature sensor using the selected function; and control the power supply unit based on the corrected temperature. The plurality of functions includes a first function and a second function. The first function produces a first corrected temperature value with respect to a given detected temperature. The second function produces a second corrected temperature value with respect to the given detected temperature. The second corrected temperature value is smaller than the first corrected temperature value. The control device is configured to: select the first function to correct the detected temperature at a start of the print control process immediately after the warm-up process; and switch from the first function to the second function at a prescribed timing during the print control process to correct the detected temperature.

According to another aspect, the present invention provides a method of correcting detected temperature of a heating member detected by a non-contact temperature sensor disposed in a position separate from the heating member. The heating member is provided in a fixing device of an image-forming apparatus. The method includes: (a) executing a first function to correct the detected temperature detected at a start of a print control process immediately after a warm-up process of the heating member, the first function producing a first corrected temperature value with respect to a given detected temperature; (b) controlling a power supply unit provided in the image-forming apparatus to control an amount of electric power supplied to the heating member based on the first corrected temperature value; (c) switching from the first function to a second function at a prescribed timing during the print control process, the second function producing a second corrected temperature value with respect to the given detected temperature, the second corrected temperature being smaller than the first corrected value; and (d) controlling the power supply unit to control an amount of electric power supplied to the heating member based on the second corrected temperature value.

BRIEF DESCRIPTION OF THE DRAWINGS

The particular features and advantages of the invention as well as other objects will become apparent from the following description taken in connection with the accompanying drawings, in which:

FIG. 2A is a diagram showing a first map for setting functions during a print control process;

FIG. 2B is a diagram showing a second map for setting functions during a print control process;

FIG. 2C is a diagram showing a third map for setting functions during a print control process.

DETAILED DESCRIPTION

<Overall Structure of a Laser Printer>

Next, a preferred embodiment of the present invention will be described while referring to the accompanying drawings.

Figure 1:
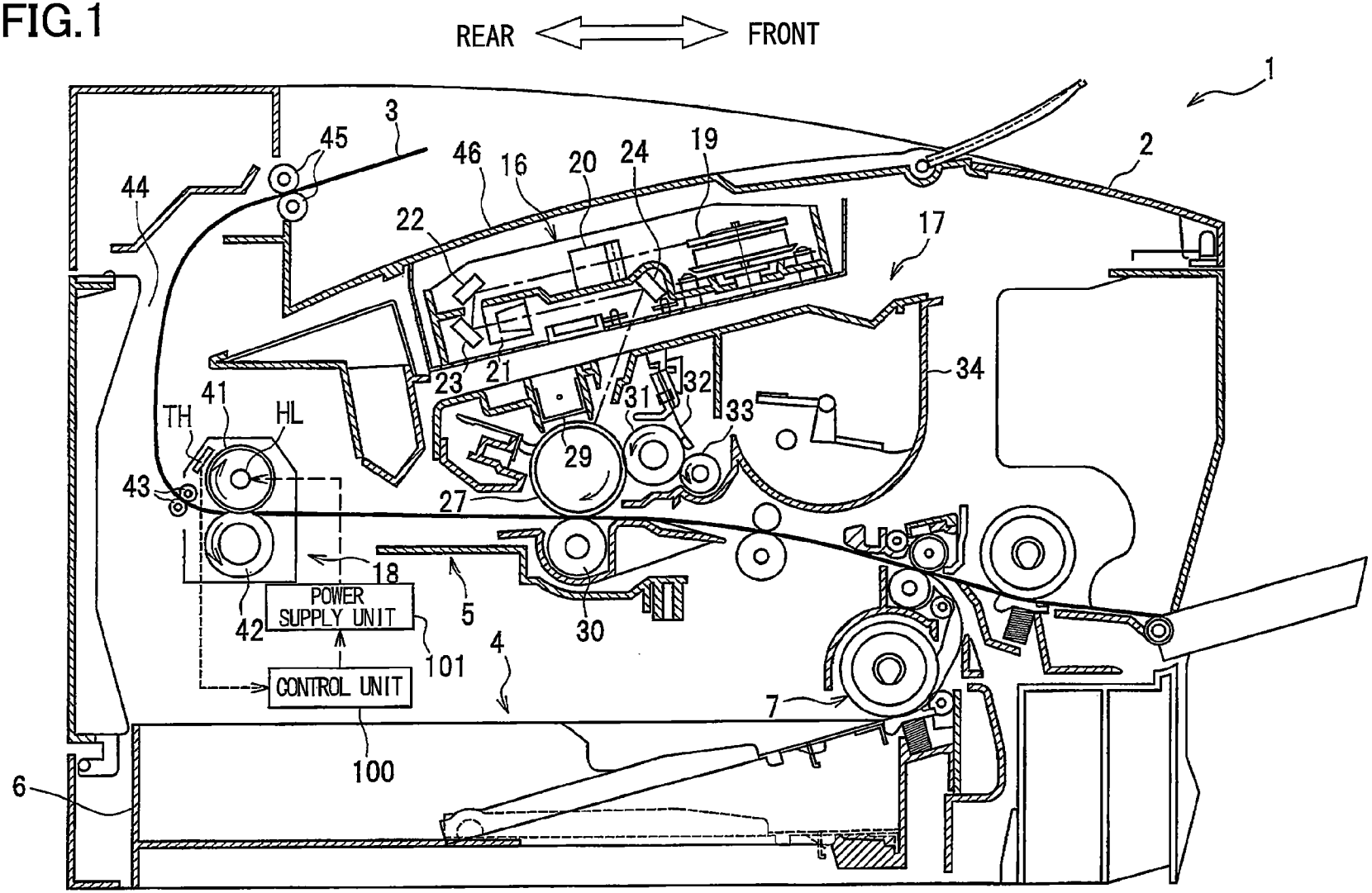
FIG. 1 is a cross-sectional side view of a laser printer according to an embodiment of the present invention.

As shown in FIG. 1, a laser printer 1 is provided with an apparatus body 2, a feeding unit 4 for feeding sheets 3 of paper to be printed, and an image-forming unit 5 for forming images on sheets 3 supplied by the feeding unit 4.

The feeding unit 4 includes a paper tray 6, and a sheet-feeding mechanism 7. The paper tray 6 is removably mounted in the bottom section of the apparatus body 2 and accommodates a stack of sheets 3. The sheet-feeding mechanism 7 picks up sheets 3 from the paper tray 6 and conveys the sheets 3 one at a time to the image-forming unit 5.

The image-forming unit 5 includes a scanning unit 16, a process cartridge 17, and a fixing unit 18.

The scanning unit 16 is disposed in the top section of the apparatus body 2. The scanning unit 16 includes a laser light-emitting unit (not shown), a polygon mirror 19 that is driven to rotate, lenses 20 and 21, and reflecting mirrors 22, 23, and 24. The laser light-emitting unit of the scanning unit 16 irradiates a laser beam that follows a path indicated by the chain line in FIG. 1 and is irradiated onto the surface of a photosensitive drum 27 in the process cartridge 17 described next through a high-speed scan.

The process cartridge 17 is detachably mounted in the apparatus body 2 at a position below the scanning unit 16. The process cartridge includes the photosensitive drum 27, a charger 29, a transfer roller 30, a developing roller 31, a thickness-regulating blade 32, a supply roller 33, and a toner hopper 34.

In the process cartridge 17 having this construction, the charger 29 applies a charge to the surface of the photosensitive drum 27, and the scanning unit 16 subsequently irradiates a laser beam onto the surface to form an electrostatic latent image thereon. The supply roller 33 supplies toner from the toner hopper 34 onto the developing roller 31, and the developing roller 31 supplies the toner in turn onto the latent image to form a toner image on the surface of the photosensitive drum 27. The toner image is subsequently transferred onto a sheet 3 as the sheet 3 is conveyed between the photosensitive drum 27 and transfer roller 30.

The fixing unit 18 includes a heating roller 41, a halogen lamp HL, a pressure roller 42, and a thermistor TH.

The heating roller 41 is a cylindrical member functioning to apply heat to the sheets 3. The halogen lamp HL is disposed inside the heating roller 41 for generating heat that is conveyed to the sheets 3 via the heating roller 41. A power supply unit 101 is provided in the apparatus body 2 for supplying power to the halogen lamp HL and the halogen lamp HL generates heat upon receiving this power.

The pressure roller 42 is disposed in confrontation with the heating roller 41 and applies pressure to the same. With this configuration, a nip part is formed between the heating roller 41 and pressure roller 42.

The thermistor TH is a non-contact sensor that detects the temperature around the heating roller 414 (hereinafter called the "ambient temperature"). Thus, the thermistor TH is separated from the surface of the heating roller 41.

In the fixing unit 18 having this construction, the heating roller 41 is heated by the halogen lamp HL so that a toner image transferred onto a sheet 3 is thermally fixed to the sheet 3 as the sheet 3 passes between the heating roller 41 and pressure roller 42. Following the fixing operation in the fixing unit 18, conveying rollers 43 disposed downstream of the fixing unit 18 convey the sheet 3 along a discharge path 44. Discharge roller 45 disposed at the end of the discharge path 44 discharge the sheet 3 from the discharge path 44 onto a discharge tray 46.

<Control Unit>

Next, a control unit 100 will be described. The control unit 100 is configured of a CPU, RAM, ROM, and input/output circuit. The control unit 100 performs computations for controlling the power supply unit 101, sheet-feeding mechanism 7, and the like based on input received from the thermistor TH described above, the content of print commands, programs and data stored in ROM, and the like.

The control unit 100 selects one of a plurality of functions to correct the temperature detected by the thermistor TH and controls the power supply unit 101 based on the corrected temperature. More specifically, the control unit 100 increases an energizing amount E outputted from the power supply unit 101 (the duty cycle of the power supply unit 101) as the difference between the corrected temperature and a fixing temperature (the suitable temperature for thermally fixing toner on the sheet 3) increases.

The control unit 100 controls the power supply unit 101 differently in each of the plurality of modes, including a warm-up mode, ready mode, sleep mode, and print mode. Since the present invention applies to the control process in the print mode (print control), suitable control processes known in the art may be employed in the other modes. These other control processes will not be addressed herein. However, since the warm-up mode pertains to the present invention, control for this mode will be described briefly below.

<Warm-up Mode>

The control unit 100 enters the warm-up mode if a print command is received while the control unit 100 is in the sleep mode or ready mode. In the warm-up mode, the control unit 100 first controls the power supply unit 101 to begin supplying power to the halogen lamp HL and then corrects the temperature detected by thermistor TH using a prescribed function. Here, a function known in the art may be used during the warm-up mode to correct the detected temperature.

The control unit 100 monitors the corrected temperature and determines whether the corrected temperature has reached a target temperature (the fixing temperature described above, or a temperature slightly lower than the fixing temperature). When the target temperature is reached, the control unit 100 exits the warm-up mode and enters the print mode. The control unit 100 controls the sheet-feeding mechanism 7 according to a method known in the art in order to delay the timing at which the sheet 3 is fed from the paper tray 6 more when the temperature detected at the start of the warm-up mode is low than when the detected temperature is high.

<Print Mode>

Upon entering the print mode after completing a warm-up operation, the control unit 100 switches the function using one of first through third maps shown in FIGS. 2A-2C. Note that it is not always necessary to switch functions during the print mode using the first through third maps when a warm-up operation has not just been completed (for example, when a second print command was outputted immediately after a first print command).

The first map is used when a detected temperature Ts at the start of the warm-up operation was low. Here, a low temperature is defined as 50° C. or less. The first map divides the length of time in which the control unit 100 is in the print mode, from start to finish, into four intervals and sets a different function for each interval. More specifically, the first interval in the first map is an 8-second interval beginning from the start of the print mode. The second interval is a 10-second interval beginning from the endpoint of the first interval, and the third interval is a 25-second interval beginning from the endpoint of the second interval. The fourth interval lasts from the endpoint of the third interval until the end of the print control process.

In the first interval of the first map, the control unit 100 uses the first-interval function for low temperatures T=1.2x+25 (where T is the corrected temperature, and x is the detected temperature). In the second interval, the control unit 100 uses the second-interval function for low temperatures T=1.2x+10. In the third interval, the control unit 100 uses the third-interval function for low temperatures T=1.2x+5. In the fourth interval, the control unit 100 uses the fourth-interval function for low temperatures T=1.2x−5.

In other words, when the detected temperature Ts at the beginning of the warm-up operation is no greater than 50° C., indicating a low temperature, the control unit 100 sequentially changes functions to those that produce gradually lower corrected values as print control progresses.

The second map is used when the detected temperature Ts at the start of the warm-up operation was moderate. Here, a moderate temperature is defined as greater than 50° C. and less than or equal to 100° C. As with the first map, the second map divides the length of time in which the control unit 100 is in the print mode from start to finish into four intervals and sets a different function for each interval. The four intervals have the same lengths described for the first map.

In the first interval of the second map, the control unit 100 uses the first-interval function for moderate temperatures T=1.2x+15. In the second interval, the control unit 100 uses the second interval function for moderate temperatures T=1.2x+5. In the third interval, the control unit 100 uses the third-interval function for moderate temperatures T=1.2x+3. In the fourth interval, the control unit 100 uses the fourth-interval function for moderate temperatures T=1.2x−5.

In other words, when the detected temperature Ts at the beginning of the warm-up operation is greater than 50° C. but no greater than 100° C., indicating a moderate temperature, the control unit 100 sequentially changes functions to those that produce gradually lower corrected values as print control progresses.

The third map is used when the detected temperature Ts at the start of the warm-up operation was high. Here, a high temperature is defined as greater than 100° C. The third map divides the length of time in which the control unit 100 is in the print mode from start to finish into two intervals and sets a different function for each interval. Specifically, the first interval in the third map is a four-second interval beginning from the start of the print mode. The second interval lasts from the endpoint of the first interval until the end of the print control process.

In the first interval, the control unit 100 uses the first-interval function for high temperatures T=1.2x. In the second interval, the control unit 100 uses the second-interval function for high temperatures T=1.2x−5.

In other words, when the detected temperature Ts at the beginning of the warm-up operation is greater than 100° C., indicating a high temperature, the control unit 100 changes the function in order to produce a lower corrected value as print control progresses.

To put it another way, the first-interval function for high temperatures T=1.2x and second interval function for high temperatures T=1.2x−5 have the same relationship as a first function and a second function that produces a smaller corrected value than the first function.

By setting the first and second-interval functions for high temperatures in this way, the first-interval function for high temperatures produces a larger corrected value at the start of print control following completion of a warm-up operation than a corrected value produced using the second-interval function for high temperatures. Accordingly, the control unit 100 can produce a corrected temperature that approximates the actual temperature at the start of a print control process following completion of a warm-up operation, even when the difference between the actual temperature of the heating roller 41 and the detected temperature is great, thereby preventing the temperature of the heating roller 41 from rising too high.

Note that the relationship between the first-interval function for low temperatures T=1.2x+25 and the fourth-interval function for low temperatures T=1.2x−5 and the relationship between the first-interval function for moderate temperatures T=1.2x+15 and the fourth-interval function for moderate temperatures T=1.2x−5 are identical to the relationship between the first function and the second function described above. Therefore, the same effects described above can be obtained for low-temperature and moderate-temperature conditions.

Further, the first-interval function for high temperatures T=1.2x and the first-interval function for low temperatures T=1.2x+25 have the same relationship as that between the first function and a third function that produces a larger corrected value than the first function.

Here, the difference between the actual temperature of the heating roller 41 and the ambient temperature at the start of print control is greater when the detected temperature Ts at the start of a warm-up operation was low than when the detected temperature Ts was high. Therefore, if the same first function (T=1.2x) were used to correct temperatures at the start of print control, regardless of the temperature detected at the start of the warm-up operation, the corrected temperature under low-temperature conditions would not approximated the actual temperature and may result in the temperature of the heating roller 41 rising too high at the start of print control. However, by correcting the detected temperature at the start of print control using a third function (T=1.2x+25) that produces a larger corrected value than the first function (T=1.2x) when the detected temperature Ts was low at the start of the warm-up operation can prevent the temperature of the heating roller 41 from rising too high.

Note that the first-interval function for high temperatures T=1.2x and the first-interval function for moderate temperatures T=1.2x+15 have the same relationship as the first function and third function described above and can thereby obtain the same effects described above for moderate-temperature conditions.

Further, at low temperatures the control unit 100 is configured to use the second-interval function for low temperatures T=1.2x+10 and the third-interval function for low temperatures T=1.2x+5 prior to switching from the first-interval function for low temperatures T=1.2x+25 to the fourth interval function for low temperatures T=1.2x−5 so as to produce corrected values that are smaller than those produced by the first-interval function for low temperatures and larger than those produced by the fourth-interval function for low temperatures. Hence, the second and third-interval functions for low temperatures correspond to a fourth function.

Here, the difference between the temperature of the heating roller 41 and the ambient temperature is great when the detected temperature Ts at the start of a warm-up operation is low. Therefore, if the function used for correcting temperatures is switched abruptly from the first-interval function for low temperatures T=1.2x+25 to the fourth-interval function for low temperatures T=1.2x−5, the corrected temperature after this switch would not approximate the actual temperature, potentially increasing the temperature of the heating roller 41 too much. However, by setting the second-interval function for low temperatures T=1.2x+10 and the third-interval function for low temperatures T=1.2x+5 for producing corrected temperatures between those produced by the first and fourth-interval functions for low temperatures when the detected temperature Ts is low at the start of the warm-up operation, it is possible to suppress this problem.

Note that the second-interval function for moderate temperatures T=1.2x+5 and the third-interval function for moderate temperatures T=1.2x+3 also correspond to the fourth function when the first-interval function for moderate temperatures T=1.2x+15 is treated as the third function and the fourth-interval function for moderate temperatures T=1.2x−5 is treated as the second function. Hence, the same effects described above can be obtained in moderate-temperature conditions.

The first interval in each map described above is set to an interval beginning when the corrected temperature reaches the target temperature described above and ending when the leading edge of the sheet 3 reaches the nip part between the heating roller 41 and pressure roller 42. Here, the first interval is set to eight seconds in both the first and second maps and four seconds in the third map so that the timing at which a sheet is fed delayed more when the detected temperature Ts at the start of the warm-up operation was low than when the detected temperature Ts was high.

In other words, the timing for switching from the first-interval function for low temperatures (third function) to the second-interval function for low temperatures (fourth function) is set later than the timing for switching from the first-interval function for high temperatures (first function) to the second-interval function for high temperatures (second function). In this way, functions can be switched to match the timing at which the sheet 2 arrives at the nip part between the heating roller 41 and pressure roller 42, regardless of the temperature conditions. That is, good fixing control can be achieved by switching functions to match the timing at which the difference between the actual temperature of the heating roller 41 and the ambient temperature decreases due to the sheet 3 absorbing heat from the heating roller 41.

The timing for switching from the first-interval function for moderate temperatures (third function) to the second-interval function for moderate temperatures (fourth function) is also set later than the timing for switching from the first-interval function for high temperatures (first function) to the second-interval function for high temperatures (second function). Therefore, the same effects described above can be obtained under moderate-temperature conditions.

Note that the lengths of the second and third intervals in the first and second maps can be set to match rising trends in ambient temperatures found through experimentation, simulations, and the like.

Next, the control process executed by the control unit 100 for correcting temperatures after entering the warm-up mode will be described.

Figure 3:
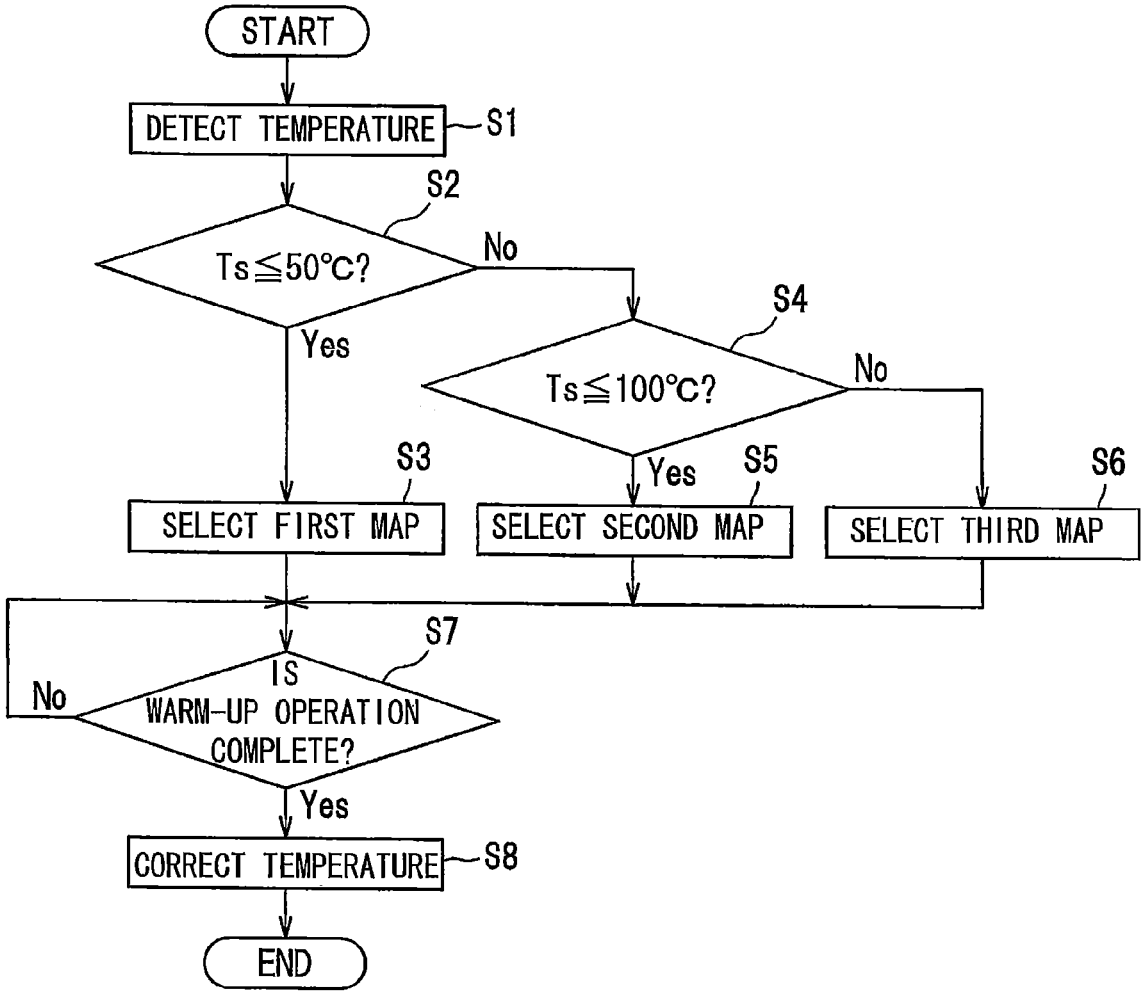
FIG. 3 is a flowchart illustrating steps in operations of a control unit.

In S1 of the flowchart shown in FIG. 3, the control unit 100 detects the ambient temperature using the thermistor TH. In S2 the control unit 100 determines whether the detected temperature Ts at the start of the warm-up operation is less than or equal to 50° C.

If the control unit 100 determines that the detected temperature Ts at the start of the warm-up operation is less than or equal to 50° C. (S2: YES), in S3 the control unit 100 selects the first map. If the control unit 100 determines that the detected temperature Ts is greater than 50° C. (S2: NO), in S4 the control unit 100 determines whether the detected temperature Ts is less than or equal to 100° C.

If the control unit 100 determines that the detected temperature Ts is less than or equal to 100° C. (S4: YES), in S5 the control unit 100 selects the second map. However, if the control unit 100 determines that the detected temperature Ts is greater than 100° C. (S4: NO), in S6 the control unit 100 selects the third map.

After completing one of the steps S3, S5, or S6, in S7 the control unit 100 determines whether the warm-up operation has completed. If the warm-up operation has completed (S7: YES), in S8 the control unit 100 sets the function to be used for correcting temperatures based on the map selected in S3, S5, or S6 and executes temperature correction based on this function.

While the invention has been described in detail with reference to specific embodiment thereof, it would be apparent to those skilled in the art that many modifications and variations may be made therein without departing from the spirit of the invention, the scope of which is defined by the attached claims.

In the embodiment described above, functions are set according to one of three possible maps, but the number of available maps may be set to only one, two, or more than three. Further, specific values used for the detected temperatures Ts, intervals, and the like in each map may be adjusted as deemed necessary and are not limited to the values given in the embodiment. Further, while multiple maps have been configured to correspond to different temperatures detected at the start of a warm-up operation, these maps may be configured based on the types of recording sheets being used, for example.

While recording sheets in the embodiment are described as sheets 3 of paper, which may include normal paper, thin paper, heavy paper, postcards, and the like, the present invention may be applied to transparencies or other types of recording sheets as well.

While the heating roller 41 and the halogen lamp HL serve as examples of heating members in the preferred embodiment, the present invention may be applied to heating resistors or induction heaters, for example. Here, while the induction heater itself does not produce heat, its electromagnetic-induction heating system can generate heat in rollers or metal belts.

While "temperature" in the embodiment is described as a temperature measured in units of ° C., the present invention may employ a voltage value or a resistance value of a resistive element in the thermistor TH used for detecting temperature as the "temperature." Alternatively, the present invention may employ data obtained by converting temperature in units of ° C. to a suitable value as the "temperature."

While the present invention is applied to the laser printer 1 in the preferred embodiment, the present invention may be applied to other types of image-forming apparatus, including copy machines and multifunction peripherals.

What is claimed is:

1. An image-forming apparatus comprising:

a fixing device having a heating member configured to heat a recording sheet;

a power supply unit configured to supply electric power to the heating member;

a non-contact temperature sensor disposed in a position separate from the heating member and configured to detect temperature of the heating member; and a control device configured to:

start a print control process after completion of a warm-up process of the heating member;

select one of a plurality of functions to correct the detected temperature detected by the non-contact temperature sensor using the selected function; and control the power supply unit based on the corrected temperature, wherein the plurality of functions includes a first function that produces a first corrected temperature value with respect to a given detected temperature and a second function that produces a second corrected temperature value with respect to the given detected temperature, the second corrected temperature value being smaller than the first corrected temperature value, and wherein the control device is configured to:

select the first function to correct the detected temperature at a start of the print control process immediately after the warm-up process; and switch from the first function to the second function at a prescribed timing during the print control process to correct the detected temperature.

2. The image-forming apparatus according to claim 1, wherein the control device is configured to switch from the first function to the second function upon a prescribed period of time elapsing after the print control process is started.

3. The image-forming apparatus according to claim 1, wherein the plurality of functions further includes a third function that produces a third corrected temperature value with respect to the given temperature, the third corrected temperature value being larger than the first corrected temperature value, and wherein the control device is configured to select the third function to correct the detected temperature at the start of the print control process when the detected temperature at a start of the warm-up process is lower than a prescribed temperature, and switch from the third function to the second function during the print control process to correct the detected temperature.

4. The image-forming apparatus according to claim 3, wherein the control device is configured to switch from the third function to the second function upon a prescribed period of time elapsing after the print control process is started.

5. The image-forming apparatus according to claim 3, wherein the plurality of functions further includes a fourth function that produces a fourth corrected temperature value with respect to the given temperature, the fourth corrected temperature value being larger than the second corrected temperature value and smaller than the third corrected temperature value, and wherein the control device is configured to switch from the third function to the fourth function prior to switching to the second function during the print control process.

6. The image-forming apparatus according to claim 5, wherein the control device is configured to switch from the third function to the fourth function upon a prescribed period of time elapsing after the print control process is started.

7. The image-forming apparatus according to claim 5, wherein the control device is configured to delay timing for switching from the third function to the fourth function than timing for switching from the first function to the second function.

8. The image-forming apparatus according to claim 1, wherein the non-contact temperature sensor includes a thermistor.

9. A method of correcting detected temperature of a heating member detected by a non-contact temperature sensor disposed in a position separate from the heating member, the heating member being provided in a fixing device of an image-forming apparatus, the method comprising:

(a) executing a first function to correct the detected temperature detected at a start of a print control process immediately after completion of a warm-up process of the heating member, the first function producing a first corrected temperature value with respect to a given detected temperature;

(b) controlling a power supply unit provided in the image-forming apparatus to control an amount of electric power supplied to the heating member based on the first corrected temperature value;

(c) switching from the first function to a second function at a prescribed timing during the print control process, the second function producing a second corrected temperature value with respect to the given detected temperature, the second corrected temperature being smaller than the first corrected value; and (d) controlling the power supply unit to control an amount of electric power supplied to the heating member based on the second corrected temperature value.

10. The method according to claim 9, further comprising:

(e) executing a third function to correct the detected temperature detected at the start of the print control process when the detected temperature at a start of a warm-up process is lower than a prescribed temperature, the third function producing a third corrected temperature value with respect to the given detected temperature, the third corrected temperature value being larger than the first corrected temperature value;

(f) controlling the power supply unit to control an amount of electric power supplied to the heating member based on the third corrected temperature value;

(g) switching from the third function to the second function at a prescribed timing during the print control process; and (h) controlling the power supply unit to control an amount of electric power supplied to the heating member based on the second corrected temperature value.

11. The method according to claim 10, further comprising:

(i) switching the third function to a fourth function prior to switching to the second function during the print control process, the fourth function producing a fourth corrected temperature value with respect to the given detected temperature, the fourth corrected temperature value being larger than the second corrected temperature value and smaller than the third corrected temperature value; and (j) controlling the power supply unit to control an amount of electric power supplied to the heating member based on the fourth corrected temperature value.

* * * * *